United States Patent [19]

Ho

[11] Patent Number: 4,533,460

[45] Date of Patent: Aug. 6, 1985

[54] OIL SHALE EXTRACTION PROCESS

[75] Inventor: Phillman N. Ho, Yorba Linda, Calif.

[73] Assignee: Union Oil Company of California, Los Angeles, Calif.

[21] Appl. No.: 651,045

[22] Filed: Sep. 14, 1984

[51] Int. Cl.[3] ..... C10G 1/04

[52] U.S. Cl. ..... 208/11 LE; 208/8 LE

[58] Field of Search ..... 208/11 LE, 8 LE, 11 R, 208/8 R

[56] References Cited

U.S. PATENT DOCUMENTS

| | | | |
|---|---|---|---|
| T700,489 | 4/1969 | Long et al. . | |
| 1,327,572 | 1/1920 | Ryan | 208/11 LE |
| 2,847,306 | 8/1958 | Stewart et al. | 208/11 LE |
| 3,488,278 | 1/1970 | Nelson | 208/11 LE |
| 3,849,287 | 11/1974 | Gleim et al. | 208/8 LE |
| 4,189,376 | 2/1980 | Mitchell | 208/11 LE |
| 4,224,136 | 9/1980 | zu Kocker et al. | 208/8 LE |
| 4,238,315 | 12/1980 | Patzer, II | 208/11 LE |
| 4,303,495 | 12/1981 | Behrmann et al. | 208/11 LE |
| 4,389,300 | 6/1983 | Mitchell | 208/11 LE |
| 4,401,551 | 8/1983 | Mitchell | 208/11 LE |
| 4,428,821 | 1/1984 | Baset | 208/11 LE |
| 4,438,816 | 3/1984 | Urban et al. | 208/11 LE |

*Primary Examiner*—D. E. Gantz
*Assistant Examiner*—A. Pal
*Attorney, Agent, or Firm*—Yale S. Finkle; Gregory F. Wirzbicki; Dean Sandford

[57] ABSTRACT

Hydrocarbon liquids are recovered from oil shale and other solids containing organic matter by passing a liquid organic solvent downwardly through an extraction zone in contact with said solids at an elevated pressure sufficient to maintain said solvent in the liquid phase and at a temperature below about 900° F., preferably between about 650° F. and about 900° F., in order to extract hydrocarbons from the solids into the solvent. The extracted hydrocarbons are then recovered from the solvent by fractionation. Normally, heat is supplied to the extraction zone by passing a hot, nonoxidizing gas, preferably an oxygen-free gas generated within the process, downwardly through the extraction zone in cocurrent flow with the liquid organic solvent.

26 Claims, 1 Drawing Figure

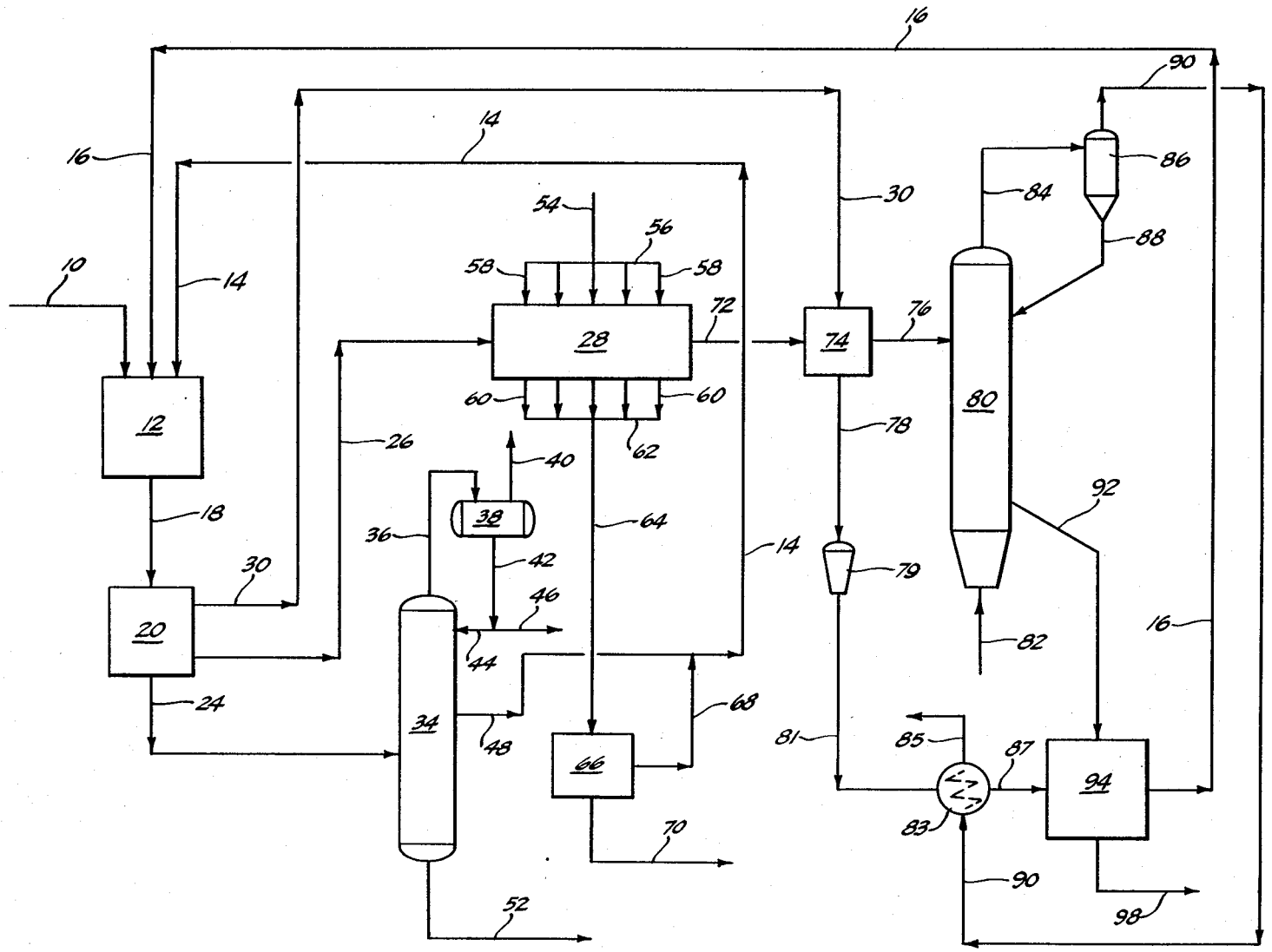
10
12
14
16
18
20
24
26
28
30
34
36
38
40
42
44
46
48
52
54
56
58
60
62
64
66
68
70
72
74
76
78
79
80
81
82
83
84
85
86
87
88
90
92
94
98

OIL SHALE EXTRACTION PROCESS

BACKGROUND OF THE INVENTION

This invention relates to a process for recovering organic material, primarily liquid hydrocarbons, from solids containing organic material and is particularly concerned with a process for extracting hydrocarbons from oil shale.

Because of a dwindling supply of petroleum liquids from underground reservoirs, attention has recently been focused on the recovery of hydrocarbon liquids and gases from solids such as oil shale, coal, industrial and municipal solid wastes and the like. Work by both governmental agencies and private industry has demonstrated that the organic materials in such solids can be converted with varying degrees of difficulty into volatile hydrocarbonaceous fluids such as combustible gases, motor fuels, heating and fuel oils, and various by-products which are of value in chemical and petrochemical industries. In general, the more attractive of the recovery techniques previously proposed involve the heat treatment of such solids in a manner sufficient to pyrolyze or otherwise decompose the organic material into the above-mentioned volatile, hydrocarbonaceous products.

Oil shale is considered to be one of the best candidates of all hydrocarbon-containing materials for processing in a retorting or pyrolysis scheme since it comprises a mixture of a minor amount of solid organic matter called kerogen and a major amount of mineral matter. The organic matter known as kerogen is a polymer which is virtually insoluble in organic solvents. Because of this insolubility, it has been difficult in the past to extract the kerogen from the oil shale and therefore the application of heat via pyrolysis or retorting has had to be used. The retorting process is carried out at relatively high temperatures, normally between about 900° F. and about 1000° F., in order to cause the solid organic matter to undergo destructive pyrolysis and simultaneous conversion into gaseous and various hydrocarbonaceous products. In general, only about 75 percent of the organic material in the oil shale is recovered as fluid products. The other 25 percent of the organic material is left as coke or a carbon-rich residue on the spent shale particles. Although this residue can be used as a fuel, it is advantageous to convert more of the organic material into recoverable liquid hydrocarbons. Furthermore, the spent shale particles contain over 95 percent by weight of inert materials and are therefore cumbersome to burn as a fuel. Another disadvantage of retorting is that it does not offer the flexibility to change the liquid yield by either decreasing or increasing the amount of carbon-rich residue remaining on the solids.

An alternative approach to retorting is to heat the oil shale in the presence of a liquid solvent to extract the organic material from the rock matrix as is taught in U.S. Pat. No. 1,327,572. In the disclosed process, ground shale is agitated with a heavy oil and heated sufficiently to liquify the hydrocarbon in the rock. Processes such as this must normally be carried out with large solvent-to-shale ratios in order to obtain liquid yields comparable to those produced in conventional retorting processes. Furthermore, it has been found that when untreated shale is mixed with solvent, the shale has a tendency to disintegrate into fines that are difficult to separate from the solvent and extracted liquids.

Accordingly, it is one of the objects of the present invention to provide a process for increasing the yield of hydrocarbon liquids from the processing of solids containing organic material. It is another object of the invention to provide a process which can be operated to avoid excessive degradation of the solids undergoing extraction. It is a further object of the invention to provide a process which can be operated at relatively low solvent-to-shale ratios. It is yet a further object of the invention to provide a process in which the liquid yields can be controlled as desired by leaving more or less organic material in the spent solids. These and other advantages of the invention will become more apparent in view of the following description of the invention.

SUMMARY OF THE INVENTION

In accordance with the invention, it has now been found that relatively large amounts of organic material can be extracted with a liquid organic solvent from hydrocarbon-containing solids such as oil shale by passing the solvent downwardly through an extraction zone in contact with the hydrocarbon-containing solids at an elevated pressure sufficient to maintain the solvent in the liquid phase and at a temperature below about 900° F., preferably between about 650° F. and about 900° F. Under these conditions hydrocarbons are extracted from the solids into the organic solvent. The extracted hydrocarbons are then recovered from the organic solvent as the liquid product. Preferably, the heat required in the extraction zone is supplied by passing a hot, nonoxidizing gas such as hydrogen, carbon dioxide, nitrogen, helium, carbon monoxide, methane, steam, an oxygen-free gas generated within the process and the like through the extraction zone. Any conventional liquid organic solvent that will dissolve the organic material in the heated solids can be used in the extraction step as long as it is not vaporizable under the conditions maintained in the extraction zone. Preferably, the solvent will be a liquid derived from the treatment of the hydrocarbon-containing solids in accordance with the process of the invention. Laboratory studies indicate that carbon conversions substantially greater than those obtainable by pyrolysis of oil shale at typical retorting temperatures can be obtained by the above method.

BRIEF DESCRIPTION OF THE DRAWING

The drawing is a schematic flow diagram of a process for recovering liquids from hydrocarbon-containing solids carried out in accordance with the invention.

DETAILED DESCRIPTION OF THE INVENTION

In the process depicted in the drawing, hydrocarbon-containing solids are introduced into the top of extractor or similar vessel 12 through line 10 from a preparation plant, not shown, in which the solids are crushed and screened or from a storage facility which does not appear in the drawing. Normally, the solids will have a top size between about 1/16 inch and about 1.0 inch, preferably between about ⅛ and about ½ inch. The feed may be any solids that contain organic material in the form of hydrocarbons. Example of such solids include oil shale, coal, lignite, solid organic wastes, and tar sands. Oil shale is the most preferred feed material.

The solids introduced into extractor 12 are passed downwardly through the vessel cocurrently with a stream of liquid organic solvent and a hot, nonoxidizing gas which are introduced into the top of the extraction vessel through lines 14 and 16, respectively. As the solids, solvent and hot gas pass cocurrently downwardly through the extractor, heat from the gas decomposes a portion of the organic material present in the feed solids into light hydrocarbon gases and lower molecular weight liquids which are dissolved by the solvent and thereby extracted from the solids. Gases, solids depleted in organic material and liquids are removed from the bottom of the extraction vessel through line 18. It is very important that the solvent not vaporize during its passage through the extraction vessel. Thus, the pressure in the extractor is maintained at an elevated value sufficient to maintain the solvent in the liquid phase. Normally, the pressure will range between about 200 p.s.i.g. and about 2000 p.s.i.g., preferably between about 300 p.s.i.g. and about 1000 p.s.i.g., and most preferably between about 400 p.s.i.g. and about 800 p.s.i.g.

Although in the embodiment of the invention discussed above, the feed solids are introduced into the top of the extraction vessel and are passed downward cocurrently with the liquid organic solvent, it will be understood that the process of the invention is not so limited. For example, the feed solids can flow perpendicular to the solvent as would be the case if a circular grate were employed as the extraction vessel.

The gas introduced into the top of the extractor through line 16 will normally be a hot recycle gas produced in the process of the invention as described in detail hereinafter. It will be understood, however, that the hot gas can be any nonoxidizing gas such as hydrogen, carbon monoxide, nitrogen, helium, methane, steam and the like. Preferably, the hot gas will be selected from the group consisting of hydrogen, nitrogen, carbon dioxide, and a recycle gas containing light hydrocarbons that are noncondensable at the temperature and pressure conditions in the extractor. The most preferred gas will be a recycle gas containing light hydrocarbons that are noncondensable at the temperature and pressure conditions in extractor 12. In general, it is desired to heat the solids in the substantial absence of added ammonia, added gaseous amines and added condensable, hydrocarbon vapors. Thus, the hot gas will normally be substantially free of such constituents. The phrases "added ammonia" and "added gaseous amines" are used herein to refer to ammonia and gaseous amines that are introduced into the process of the invention from external sources and do not include ammonia and gaseous amines that are produced in the process from constituents of the feed solids or the solvent. The phrase "added condensable, hydrocarbon vapors" as used herein refers to hydrocarbon vapors which are condensable under the temperature and pressure conditions in the extractor and which are introduced into the process of the invention from external sources. This phrase does not include hydrocarbon vapors that are produced in the process from constituents of the feed solids or the solvent. It will be understood that the solids can be heated in vessel 12 without direct contact with a hot gas. If desired, the heat can be supplied by indirect heat transfer through the walls of vessel 12 or by other well known methods of transferring heat.

The flow rate and temperature of the gas are adjusted such that the temperature in extraction vessel 12 is normally between about 650° F. and about 900° F. In general, the temperature in extractor 12 is maintained below temperatures normally utilized in conventional oil shale retorting processes. The temperature in the extraction vessel is preferably maintained between about 700° F. and about 850° F., most preferably between about 740° F. and about 820° F. Normally, the pressure in the extraction vessel will be less than the critical pressure of the gas that is passed through the extractor. The residence time of the solids in the extractor will typically range between about 5 minutes and about 200 minutes, preferably between about 15 minutes and about 80 minutes. In general, a sufficient amount of hot gas is introduced into the top of the extraction vessel so that there is a substantially continuous gaseous phase in contact with the entire bed of solids in the extraction vessel and the superficial velocity of the gas through the pressurized vessel is between about 0.01 feet per minute and about 300 feet per minute, preferably between about 0.1 feet per minute and about 12.0 feet per minute.

The solvent introduced into the top of the extraction vessel 12 through line 14 will normally be a liquid derived from the feed solids in the process of the invention. It will be understood, however, that the solvent may be any organic solvent or mixture of solvents that is a liquid under extraction conditions and will dissolve organic material from the heated solids. Examples of suitable solvents include toluene, tetralin, decalin, pyridine, pyrrolidine, and petroleum derived oil fractions. When the solids being processed are oil shale, the preferable solvent is a liquid derived from the oil shale in the process of the invention which boils between about 50° F. and about 1050° F., preferably between about 400° F. and about 850° F. and most preferably between about 470° F. and about 650° F. In the highly preferred embodiment of the invention, the flow of solvent through the bed of solids in the extraction vessel is controlled so that a trickle bed extraction exists. Thus, it is highly preferred that there be a discontinuous liquid phase in contact with the solids, i.e., that the solids in the extraction vessel never contact or pass through a liquid barrier as would occur, for example, if the solids were immersed in the liquid solvent. In other words, in the highly preferred embodiment of the invention, the extraction will be carried out such that a portion of the solids will be in contact with liquid solvent and the remainder in contact with the gas phase, said remainder having at most only a film of liquid in contact therewith. Normally, sufficient solvent is introduced into the extraction vessel to yield a solvent-to-solids hourly weight ratio between about 0.2 and about 2.0, preferably between about 0.6 and about 1.5.

The effluent from extractor 12 will normally be comprised of gases, vaporous hydrocarbons produced in the extraction vessel from the organic material in the solids, solvent containing organic material extracted from the heated solids and solids depleted in organic material. The effluent is withdrawn from the extraction vessel under pressure through line 18 and passed to depressurization system 20 where the solids are separated from the gases, vapors and liquids. Normally, the depressurization system will comprise two parallel separators. The effluent from the extraction vessel is passed into the first separator under pressure. As the liquids and solids fill the first separator, the gaseous portion of the effluent is withdrawn from the separator through line 30 and passed downstream through a pressure control valve not shown in the drawing. This gas will normally contain ammonia, carbon dioxide, hydrogen sulfide, and light hydrocarbons such as methane, ethane, propane and butane. Once the first separator is filled with liquids and solids, the flow of effluent from extraction vessel 12 is diverted under pressure into the second separator, and the first separator is vented to atmospheric pressure. Liquids are then removed from the first separator through line 24 and passed to fractionator 34 while the depressured solids in the first separator are passed through line 26 into steam stripping zone 28. Once the second separator is filled with liquids and solids, the flow of effluent from the extraction vessel is diverted under pressure back into the empty first separator. The second separator is then vented to atmospheric pressure and the liquids and solids are removed as was done with respect to the first separator. The continuous repetition of this procedure allows the process of the invention to be carried out without interruption. Normally, the depressured solids removed from the separators will contain little, if any, of the organic material originally present in the feed solids and it is therefore usually not necessary to subject these solids to another extraction with a liquid organic solvent.

The liquids removed from depressurization system 20 through line 24 comprise a mixture of solvent and extracted organic material. This mixture is passed into fractionator or similar vessel 34 where the solvent is separated from the extracted organic material and any fine particulates. Gases and lower boiling constituents of the extracted organic material are removed overhead of the fractionator through line 36, cooled and passed to distillate drum 38 where the gases are taken off overhead through line 40 and passed to downstream units for further processing. The liquid, which will contain the lighter constituents of the extracted organic material boiling in the naphtha range, is withdrawn from the distillate drum 38 through line 42. A portion of this liquid may be returned as reflux to the upper portion of the fractionator through line 44. The remaining liquid is recovered as liquid product through line 46. An intermediate boiling liquid fraction, which will normally boil between about 450° F. and about 650° F. if oil shale is the feed material to the process, is removed from fractionator 34 through line 48. This stream will normally contain the majority of the constituents comprising the solvent originally introduced into extraction vessel 12 through line 14 along with constituents of the extracted organic material that boil in the same range. This stream is recycled through lines 48 and 14 to the extraction vessel. A heavier oil fraction composed primarily of hydrocarbons boiling above the final boiling point of the fraction in line 48 is withdrawn from the fractionator through line 52 and passed downstream for hydroprocessing into desired products. If the solids fed to the process of the invention are oil shale, this heavy oil will be treated to produce a synthetic crude oil by removing olefins, arsenic, organonitrogen compounds, organosulfur compounds and trace metals. The resultant synthetic oil may then be subjected to catalytic cracking or hydrocracking depending upon the desired products.

The solids removed from depressurization system 20 through line 26 will be substantially depleted in organic material but will contain residual components of the solvent. In order to recover the residual solvent, the hydrocarbon-depleted solids are passed into steam stripping zone 28 where they are deposited on a belt conveyor, not shown in the drawing, and passed horizontally through the zone in contact with steam introduced into the stripping zone through line 54, manifold 56 and lines 58. As the hydrocarbon-depleted solids pass horizontally on the belt through the steam stripping zone, residual solvent constituents are stripped from the solids and carried with the steam from the bottom of the steam stripping zone through lines 60, manifold 62 and line 64. The mixture of steam and vaporized solvent is passed into separator or similar device 66 where the vapors are cooled to condense steam and liquid constituents of the solvent. The condensed solvent will be present in separator 66 as a layer of oil floating on water. The solvent is withdrawn from the top of the separator through line 68, mixed with recycle solvent in line 48 and passed to extraction vessel 12 via line 14. Sour water is removed from separator 66 through line 70.

After the hydrocarbon-depleted solids are subjected to steam stripping in zone 28, they are withdrawn from the zone through line 72. These solids will contain moisture and typically less than about 1.0 weight percent carbon. The wet solids passed through line 72 enter drying zone 74 where they are contacted with the hot gas containing ammonia, hydrogen sulfide and light hydrocarbons removed from depressurization system 20 through line 30. The hot gas dries the extracted solids by vaporizing water from the solids. Dried solids are withdrawn from the drying zone through line 76 and a cooled mixture of gas and water vapor is removed through line 78.

The dried solids exiting drying zone 74 are passed continuously through line 76 into fluidized bed combustor or similar device 80 where they are introduced into a fluidized bed of solids extending upward within the combustor above an internal grid or similar distribution device not shown in the drawing. The carbon-containing solids are maintained in the fluidized state within the combustor by means of an oxygen-containing gas introduced into the combustor through bottom inlet line 82. The oxygen in the gas introduced into the bottom of the combustor reacts with organic material in the solids fed to the combustor to form carbon dioxide, carbon monoxide and a substantial amount of heat, a portion of which is absorbed by the rising gas. The amount of oxygen-containing gas introduced into the bottom of the combustor is normally controlled so that all of the oxygen is consumed in the reactions that take place in the combustor. Normally, the combustor will be operated at about atmospheric pressure and at a temperature between about 1400° F. and about 1600° F.

The gas leaving the fluidized bed in combustor 80 passes through the upper section of the combustor, which serves as a disengagement zone where particles too heavy to be entrained by the gas leaving the vessel are returned to the bed. If desired, this disengagement zone many include one or more cyclone separators or the like for the removal of relatively large particles from the gas. The gas withdrawn from the upper part of the combustor through line 84 will normally contain a mixture of carbon monoxide, carbon dioxide, nitrogen, sulfur dioxide formed from the sulfur contained in the solids fed to the combustor and entrained fines. This hot flue gas is introduced into cyclone separator or similar device 86 where the fine particulates are removed and returned to the combustor 80 via dip leg 88. The hot flue gas from which the fines have been removed is withdrawn overhead from separator 86 through line 90.

The relatively cool gas stream removed from drying zone 74 through line 78, which will contain hydrogen sulfide, light hydrocarbons and water vapor, is passed to compressor 79 where its pressure is increased to a value between about 25 p.s.i. and about 150 p.s.i. above the operating pressure in extraction vessel 12. The pressurized gas is then fed through line 81 to heat exchange vessel or similar device 83 where it is passed in indirect heat exchange with the hot flue gas removed overhead from cyclone separator 86 through line 90. A cooled flue gas is removed from heat exchanger 83 through line 85 and passed downstream for other use. The heated and pressurized gas exiting the heat exchanger through line 87 is passed into contactor or similar vessel 94 where the gas is contacted with combusted particles removed from the fluidized bed in combustor 80 through line 92. If the original feed to the process is an oil shale, these decarbonized solids will contain large amounts of calcium oxide and magnesium oxide produced by the decomposition of calcium carbonate and magnesium carbonate in combustor 80. Because of the presence of these constituents, the combusted solids will remove sulfur compounds from the pressurized gas and at the same time will transfer heat directly to the gas. A hot gas essentially free of hydrogen sulfide is withdrawn from contactor 94 through line 16 and recycled to extraction vessel 12 where its heat is used to raise the temperature of the solids introduced into the vessel through line 10.

After the decarbonized solids removed from the combustor have been contacted with the gas in line 87, they are removed from contactor 94 through line 98 and can then be used to sweeten the sour water removed from separator 66 through line 70. Upon contact of this water with the deacarbonized solids, sulfur and nitrogen compounds will be adsorbed by the alkaline constituents in the combusted solids. The sweet water removed from this treatment step can then be recycled for use in the process. The solids exiting the sweetening step can then be disposed of as landfill.

In the embodiment of the invention shown in the drawing and described above, the feed solids are passed through extraction vessel 12 in the form of a downwardly moving bed. It will be understood that the process of the invention is not limited to the use of a moving bed of solids. For example, it may be desirable to use a fixed or packed bed of solids instead of a moving bed. In such an embodiment of the invention, several extraction vessels in parallel are utilized and a separate steam stripping zone as represented by reference numeral 28 is not required. In the first extraction vessel, a liquid solvent and a hot, nonoxidizing gas are passed downwardly through a fixed bed of feed solids to extract organic material therefrom. While this is taking place, steam is passed downwardly through a second extraction vessel containing a fixed bed of feed solids that have already undergone extraction in order to strip residual solvent constituents from the extracted solids. Meanwhile, a third extraction vessel containing a fixed bed of feed solids which have undergone extraction and steam stripping is emptied of extracted and stripped solids and then reloaded with a fresh charge of feed solids. The extracted and stripped solids are passed to drying zone 74. When the extraction is completed in the first fixed bed extraction vessel, the solvent and gas are then diverted into the third extraction vessel where they are passed downwardly through the fixed bed of fresh feed solids. At the same time, steam is diverted from the second extraction vessel into the first fixed bed extraction vessel in order to steam strip the extracted solids. The second extraction vessel is then unloaded of extracted and steam stripped solids and reloaded with fresh feed solids. This procedure allows for the continuous operation of the process.

The nature and objects of the invention are further illustrated by the following Example, which is provided for illustrative purposes only and not to limit the invention as defined by the claims.

EXAMPLE 1

In this series of tests, 125 grams of oil shale containing 26 gallons per ton of oil from the Green River formation in Colorado are placed in an upright tubular reactor. The reactor is a three foot long stainless steel welded tube having an outside diameter of 1 inch and an inside diameter of $\frac{5}{8}$ inch. The shale is supported in the reactor between two beds of glass beads and a layer of glass wool is located near the bottom of the lower bed of beads. The reactor containing the shale is immersed in a fluidized bed sand bath and heated to a temperature of 788° F. The desired extraction solvent is then passed downwardly from the top of the reactor through the bed of shale solids simultaneously and cocurrently with nitrogen or hydrogen gas for a desired length of time. The flow rate of the gas ranges between 2.0 and 2.5 standard cubic feet per hour. The pressure in the reactor is controlled by a back pressure regulator which is set to maintain the desired run pressure. After the shale is heated for the desired length of time, the flow of solvent through the reactor is terminated and the temperature of the sand bath is lowered such that the temperature of the shale decreases. The gas is continuously passed through the reactor during the cooling step. After the shale has been cooled, the flow of gas through the bed is terminated and steam is passed downwardly through the packed bed of shale to strip any residual solvent from the bed. The shale is then dried by passing nitrogen through the bed. After the shale is dried, the reactor is removed from the sand bath and a portion of the dried shale is analyzed for residual carbon content. A sample of the shale originally placed in the reactor is subjected to Fischer Assay conversion at 932° F. and the spent shale produced is analyzed for residual carbon. The ratio of the carbon left in the extracted shale to the carbon left in the shale subjected to Fischer Assay is calculated for each run. The results of this series of tests are summarized in Table I below. No significant degradation of the oil shale is observed when the dried shale is removed from the reactor and inspected.

TABLE 1

| Run No. | Residence Time (hrs.) | Gas Type | Solvent Flow Rate (gms/hr.) | Pressure (p.s.i.g.) | Organic Carbon Conversion (% Fischer Assay) |
|---|---|---|---|---|---|
| 1 | 1.0 | $H_2$ | 117.5* | 500 | 124 |
| 2 | 1.0 | $H_2$ | — | 500 | 104 |
| 3 | 1.5 | $H_2$ | 75.0* | 500 | 119 |
| 4 | 1.0 | $H_2$ | 125.0** | 500 | 128 |
| 5 | 1.0 | $N_2$ | 137.5* | 500 | 124 |
| 6 | 1.5 | $N_2$ | 112.5* | 500 | 125 |
| 7 | 1.5 | $H_2$ | 112.5* | 200 | 99 |
| 8 | 1.5 | $H_2$ | 175.0* | 0 | 100 |

*Hydrotreated shale oil boiling between 475° F. and 650° F.
**A full range boiling hydrotreated shale oil.

As can be seen from the data for run 1 in Table 1, an organic carbon conversion of 124 percent of Fischer Assay is obtained at a residence time of 1 hour and a pressure of 500 p.s.i.g. with both gas and solvent flowing through the fixed bed of shale solids. The Fischer Assay conversion represents the carbon conversion normally expected from retorting. Thus, run 1 indicates that the extraction process of the invention results in significant yield increases over conventional retorting methods. A comparison of runs 1 and 2 indicates that it is necessary to have solvent flowing through the bed in order to achieve high carbon conversions at a 1 hour residence time.

A comparison of the data from runs 1 and 3 indicates that the flow rate of the solvent through the bed affects the organic carbon conversion. In run 3, which is carried out at a residence time greater than the residence time in run 1, the flow rate of solvent was 75 grams per hour compared to 117.5 grams per hour in run 1. The organic carbon conversion in run 3 is 119 percent Fischer Assay as compared to 124 percent Fischer Assay obtained in run 1. Clearly, the flow rate of the solvent will directly affect the organic carbon conversion obtained.

The solvent used in run 4 is a full range boiling hydrotreated shale oil as opposed to the hydrotreated shale oil used in run 1, which boiled between 475° F. and 650° F. The organic carbon conversion for run 1 is 124 percent Fischer Assay as opposed to 128 percent Fischer Assay for run 4. These data indicate that the presence of high boiling constituents in the solvent does not adversly affect organic carbon conversion.

Nitrogen was used as the flowing gas in runs 5 and 6. A comparison of the data from these runs with the data from run 1 indicates that the type of gas used does not significantly affect organic carbon conversion.

The data for runs 7 and 8 indicate that organic carbon conversions are no better than Fischer Assay conversions when the pressure during the extraction is 200 p.s.i.g. or below. This is true even when the flow rate of solvent is dramatically increased as is the case in run 8. The data for these runs indicate that the pressure of the extraction must normally be above about 200 p.s.i.g. when using a solvent boiling between 475° F. and 650° F. It is believed that the low carbon conversion obtained in runs 7 and 8 are the result of the solvent or a portion thereof being in the vapor phase instead of the liquid phase at the relatively low run pressures.

It will be apparent from the foregoing that the process of the invention provides a method for recovering hydrocarbon liquids from oil shale and other solids containing organic material in quantities greater than that normally obtainable by conventional retorting techniques. Furthermore, the process of the invention can be carried out with the use of less solvent and without the degradation of solids that are normally encountered when conventional slurry extraction techniques are utilized. As a result, the overall cost of liquids produced may be substantially reduced.

Although this invention has been primarily described in conjunction with an example and by reference to embodiments thereof, it is evident that many alternatives, modifications and variations will be apparent to those skilled in the art in light of the foregoing description. Accordingly, it is intended to embrace within the invention all such alternatives, modifications and variations that fall within the spirit and scope of the appended claims.

I claim:

1. A process for recovering hydrocarbon liquids from solids containing organic material which comprises:

(a) passing a liquid organic solvent and a hot, nonoxidizing gas downwardly through an extraction zone in contact with said solids at an elevated pressure sufficient to maintain said solvent in the liquid phase and at a temperature below about 900° F. but sufficiently high such that hydrocarbons are extracted from said solids into said organic solvent;

(b) withdrawing said liquid organic solvent and said extracted hydrocarbons from the bottom of said extraction zone; and (c) recovering said extracted hydrocarbons from said liquid organic solvent as said hydrocarbon liquids.

2. A process as defined by claim 1 wherein said solids containing organic material comprise oil shale and the temperature in said extraction zone is maintained between about 650° F. and about 900° F.

3. A process as defined by claim 1 wherein said solids move downwardly through said extraction zone cocurrently with said solvent.

4. A process as defined by claim 1 wherein said solids form a fixed bed within said extraction zone.

5. A process as defined by claim 1 wherein said hot gas comprises a gas selected from the group consisting of hydrogen, carbon dioxide, nitrogen, helium, carbon monoxide, methane, steam, an oxygen-free flue gas, and a recycle gas generated within said process.

6. A process as defined by claim 1 wherein the pressure in said extraction zone is maintained between about 200 p.s.i.g. and about 2000 p.s.i.g.

7. A process as defined by claim 2 wherein the temperature in said extraction zone is maintained between about 700° F. and about 850° F.

8. A process as defined by claim 1 wherein the pressure in said extraction zone is maintained below the critical pressure of said hot gas.

9. A process as defined by claim 2 wherein said liquid organic solvent is selected from the group consisting of toluene, tetralin, decalin, petroleum derived oil fractions and liquids derived from said solids containing said organic material.

10. A process as defined by claim 2 wherein said solvent comprises liquids derived from oil shale.

11. A process as defined by claim 10 wherein said liquids derived from said oil shale boil between about 400° F. and about 850° F.

12. A process for recovering hydrocarbon liquids from oil shale solids which comprises:

(a) passing a liquid organic solvent and a hot, nonoxidizing gas downwardly through an extraction zone in contact with said solids at an elevated pressure sufficient to maintain substantially all of said solvent in the liquid phase but below the critical pressure of said gas and at a temperature between about 650° F. and about 900° F. such that hydrocarbons are extracted from said solids into said organic solvent;

(b) withdrawing said liquid organic solvent and said extracted hydrocarbons from the bottom of said extraction zone; and (c) recovering said extracted hydrocarbons from said liquid organic solvent as said hydrocarbon liquids.

13. A process as defined by claim 12 wherein said shale solids form a fixed bed within said extraction zone.

14. A process as defined by claim 12 wherein said solids move downwardly through said extraction zone cocurrently with said solvent.

15. A process as defined by claim 12 wherein said liquid organic solvent is selected from the group consisting of toluene, tetralin, decalin, pyridine, petroleum derived oil fractions and shale derived liquids.

16. A process as defined by claim 14 wherein said solvent comprises liquids boiling between about 400° F. and about 850° F. that are extracted from said oil shale solids in step (a) of claim 12.

17. A process as defined by claim 12 wherein the pressure in said extraction zone ranges between about 300 p.s.i.g. and about 1000 p.s.i.g.

18. A process as defined by claim 12 wherein said extracted hydrocarbons are recovered from said organic solvent by fractionation.

19. A process as defined by claim 12 wherein said hot, nonoxidizing gas is selected from the group consisting of hydrogen, carbon dioxide, nitrogen, helium, carbon monoxide, methane, steam, an oxygen-free flue gas and a recycle gas generated within said process.

20. A process as defined by claim 12 including the additional step of contacting the extracted solids from step (a) with steam under conditions such that residual constituents of said organic solvent are removed from said extracted solids.

21. A process for recovering hydrocarbon liquids from oil shale solids which comprises:

(a) introducing a liquid organic solvent into an extraction zone at a point near or at the top of said extraction zone;

(b) introducing a hot, nonoxidizing gas into said extraction zone at a point near or at the top of said extraction zone;

(c) passing said liquid organic solvent and said hot, nonoxidizing gas downwardly through said extraction zone in contact with said oil shale solids at an elevated pressure sufficient to maintain said solvent in the liquid phase but below the critical pressure of said gas and at a temperature between about 650° F. and about 900° such that hydrocarbons are extracted from said solids into said organic solvent, wherein the flow of said solvent through said extraction zone is controlled so that a trickle bed extraction exists;

(d) withdrawing said liquid organic solvent and said extracted hydrocarbons from said extraction zone at a point near or at the bottom of said extraction zone; and (e) recovering said extracted hydrocarbons from said liquid organic solvent as said hydrocarbon liquids.

22. A process as defined in claim 21 wherein said solids move downwardly through said extraction zone cocurrently with said solvent and said hot, nonoxidizing gas.

23. A process as defined by claim 21 wherein said solids form a fixed bed within said extraction zone.

24. A process as defined by claim 21 wherein said hot, nonoxidizing gas comprises a gas selected from the group consisting of carbon dioxide, nitrogen, carbon monoxide, methane, and an oxygen-free flue gas.

25. A process as defined by claim 1 wherein said solvent is contacted with said solids in the substantial absence of added ammonia and added gaseous amines.

26. A process as defined by claim 12 wherein said solvent is contacted with said solids in the substantial absence of added ammonia and added gaseous amines.

* * * * *